US007854884B2

(12) United States Patent
Schuster et al.

(10) Patent No.: US 7,854,884 B2
(45) Date of Patent: Dec. 21, 2010

(54) METHOD AND INSTALLATION FOR PRODUCING A HOT ROLLED STRIP FROM AUSTENITIC RUST-RESISTANT STEELS

(75) Inventors: Ingo Schuster, Willich (DE); Manfred Albedyhl, Mettmann (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 821 days.

(21) Appl. No.: 10/503,100

(22) PCT Filed: Jan. 9, 2003

(86) PCT No.: PCT/EP03/00119

§ 371 (c)(1),
(2), (4) Date: Nov. 19, 2004

(87) PCT Pub. No.: WO03/064069

PCT Pub. Date: Aug. 7, 2003

(65) Prior Publication Data

US 2005/0072499 A1 Apr. 7, 2005

(30) Foreign Application Priority Data

Jan. 31, 2002 (DE) ..... 102 03 711

(51) Int. Cl.
*C21D 1/62* (2006.01)

(52) U.S. Cl. ..... 266/114; 266/103

(58) Field of Classification Search ..... 266/103, 266/114

See application file for complete search history.

(56) References Cited

U.S. PATENT DOCUMENTS 5,307,864 A 5/1994 Arvedi et al.
5,329,688 A 7/1994 Arvedi et al.
5,611,232 A 3/1997 Rohde et al.

(Continued)

FOREIGN PATENT DOCUMENTS

EP 0937512 8/1999

(Continued)

OTHER PUBLICATIONS

Patent Abstracts of Japan, vol. 011, No. 205 (M-603), Jul. 3, 1987 & JP 62 024803 A (Kawasaki Steel Corp), Feb. 2, 1987.

(Continued)

*Primary Examiner*—Scott Kastler
(74) *Attorney, Agent, or Firm*—Lucas & Mercanti, LLP; Klaus P. Stoffel

(57) ABSTRACT

An installation for producing hot-rolled strip from austenitic stainless steels; including a continuous casting machine and a rolling mill with a temperature adjustment system and a cooling system for cooling the rolling stock. The temperature adjustment system includes an installation having a furnace for preheating the cast slab to =1,150° C. and an installation for intensive heating including an inductive heating zone for adjustment of the run-in temperature of the cast slab into the finishing train of the rolling mill to above 1,150° C., for establishing a final rolling temperature to carry out the heat treatment by direct exploitation of the rolling heat. The cooling system includes a device for quenching the rolling stock to below 600° C. The temperature adjustment system includes only a first descaling system between the preheating installation and the intensive heating installation.

5 Claims, 1 Drawing Sheet

U.S. PATENT DOCUMENTS

| | | | | |
|---|---|---|---|---|
| 5,743,125 | A | 4/1998 | Kneppe et al. | |
| 6,053,996 | A | 4/2000 | Pronk et al. | |
| 6,062,055 | A | 5/2000 | Bobig et al. | |
| 6,092,586 | A * | 7/2000 | Schonbeck | 164/476 |
| 6,259,071 | B1 * | 7/2001 | Demidovitch et al. | 148/508 |

FOREIGN PATENT DOCUMENTS

| | | |
|---|---|---|
| EP | 0610028 | 5/2000 |
| JP | 08-176676 | 7/1996 |
| WO | 9826882 | 6/1998 |

OTHER PUBLICATIONS

"Corrosion" National Association of Corrosion Engineers, vol. 46, 1990, 2pages.

"ISP an innovative technology based on thin slab concept of production of hot rolled strips", G.Gosio, et al., Sep. 23, 1991, 2 pages.

"Current status of the ISP technology and new developments" J. Schoenbeck, et al., Jan. 1997, 2 pages.

"Casting and cast-rolling of thin slabe at the Mannesmannroehren-Werke AG", Hans-Juergen Ehrenberg et al., pp. 52 &58, Mar. 1989.

"ln-line Strip Production Product Information", Mannesmann Demag AG, 13 pages, Jan. 25, 1999.

* cited by examiner 1
2
3
4
5
6
7
8
9
10
11
12
13
14
16
17
18
a
b
c
d
e
f
1000-1150 °C
1000-1300 °C
1150-1250 °C
Tein
1000-1100 °C
Twe
400-650 °C
Ta 102
106
107
112
113
1100-1150 °C
1050-1100 °C
750-920 °C
500-700 °C

METHOD AND INSTALLATION FOR PRODUCING A HOT ROLLED STRIP FROM AUSTENITIC RUST-RESISTANT STEELS

The invention concerns a method for producing hot-rolled strip from austenitic stainless steels, in which, in a first step, a cast product is subjected to a rolling operation in a rolling mill with a finishing train and, in a second step, a heat treatment is carried out to prevent susceptibility to corrosion, especially intergranular corrosion due to chromium carbide precipitation. The invention also concerns an installation for producing hot-rolled strip from austenitic stainless steels that are not susceptible to selective, especially intergranular, corrosion.

It is well known that austenitic stainless steels, which are generally defined as grades of steel containing at least 10.5 wt. % chromium as well as nickel, are especially susceptible to intergranular corrosion, which is due to chromium depletion of the regions of the microstructure in the vicinity of the grain boundaries during the formation of chromium-rich precipitates on the grain boundaries and to the associated reduction of the corrosion resistance of these regions relative to microstructural regions with a high concentration of dissolved chromium. This occurs especially if they pass too slowly through critical temperature ranges during cooling. Therefore, austenitic Cr—Ni steels of this type are adjusted in the solution-annealed state. Solution heat treatment with subsequent quenching involves a heat treatment, in which, at solution heat treatment temperatures of about 1,000 to 1,100° C., the chromium of the precipitated chromium carbides goes back into solution, and the subsequent quenching operation prevents chromium carbides from re-forming by forcing the C atoms to remain in solution in the matrix. This type of solution heat treatment with subsequent quenching is carried out in a heat treatment operation that is separate from the rolling process. To this end, the rolled products are conveyed to separate heat treatment installations, in which they are subjected to a heat treatment and then rapid cooling. Solution heat treatment not only prevents the formation of chromium carbides, but also improves the cold workability of austenitic Cr—Ni steels.

EP 0 415 987 B2 describes a method for the continuous production of strip steel or steel sheet from thin slabs about 50 mm thick produced by curved-mold continuous casting with horizontal runout. This method involves the following steps: rolling of the thin slabs after solidification of the strand in the curved guide shaft at temperatures of more than 1,100° C., temperature drop of the slabs by radiation or descaling, inductive reheating to a temperature of about 1,100° C., and rolling of the thin slabs in at least one rolling train. The heating establishes a temperature in the slabs such that a temperature gradient develops in the shaping installations of the rolling train, specifically in such a way that, during the first pass into the rolling stand, the temperature is still within the range that is adequate for good shaping. Here the temperature of the rolling stock has dropped, for example, to 988° C. in a third and last rolling stand of a rolling train and is sufficient as the first pass temperature for the last rolling operation. The rolling stock leaves the last rolling stand at a temperature of 953° C. or less and is then cut into the desired lengths at a temperature that has fallen still lower and is then stacked or coiled.

In addition, installations for rolling strip and sheet from the casting heat are known and are described, for example, in Stahl & Eisen, Vol. 2, 1993, pp. 37 ff., and Flemming et al., *Die CSP Anlagentechnik und ihre Anpassung an erweiterte Produktionsprogramme [CSP Plant Engineering and Its Adaptation to Expanded Production Programs]*. In a plant of this type, a thin slab is produced by a continuous casting machine with a specially configured mold shape, cut into individual lengths, and fed into a roller hearth furnace for temperature equalization. The thin slab is then accelerated to the significantly higher run-in speed of the subsequent rolling train, descaled, and conveyed to the rolling train. During steady-state production operation with a casting speed of 5.5 m/min, the thin slab reaches the roller hearth furnace at a mean temperature of about 1,080° C. The discharge temperature from the roller hearth furnace is about 1,100° C. The thermal energy necessary for the rolling operation is thus covered almost completely by the amount of heat contained in the cast strand. In the rolling mill, the heat losses are controlled by cooling in the rolling train and by contact with the rolls, so that a desired final rolling temperature of, for example, 880° C. is established. This is followed by slow cooling in the cooling zone and then by coiling.

A common feature of both methods is that the slab temperature established as the run-in temperature into the finishing rolling stand is just sufficient to ensure rolling in the last stand of the finishing train.

The objective of the invention is to propose a method and an installation with which energy and time can be saved in the production of austenitic stainless steels.

In accordance with the basic idea of the invention, to produce hot-rolled strip or hot-rolled wide strip made of austenitic stainless steels, the heat treatment for preventing susceptibility to corrosion is carried out by directly exploiting the rolling heat, i.e., it is carried out directly following the rolling operation, by exploiting the fact that the temperatures in the strip are so high that no chromium carbides have precipitated yet or that, starting from the rolling temperatures, only very small temperature differences must be overcome to establish temperatures that cause the chromium to pass into solution. All told, the rolling product is no longer solution-annealed in a separate heat treatment step, which includes annealing from room temperature to solution heat treatment temperature, but rather the rolling product is solution-annealed by exploiting the rolling heat, which thus saves energy by eliminating the high-energy annealing operation. Therefore, the steels can be produced without carrying out a subsequent, separate heat treatment consisting of a solution heat treatment and quenching treatment, which results in savings of energy and time.

In accordance with the invention, the relatively high final rolling temperature that is desired at the end of the finishing train is achieved by establishing a run-in temperature of the cast product into the finishing train of the rolling mill that is higher than this final rolling temperature and is above 1,150° C., and preferably above 1,200° C. The temperature level of the rolling stock is then always above the temperature at which the chromium carbides could precipitate, despite the temperature gradient during the rolling operation. To achieve these run-in temperatures, the cast product is subjected to a multistage heating process, especially a two-stage heating process, which comprises a preheating stage and an intensive heating stage.

The final rolling temperature of the rolling stock is preferably adjusted to temperatures above 1,000° C., and preferably above 1,050° C., i.e., to temperatures at which the chromium of the chromium-containing stainless steels, which has a tendency to form carbide precipitates, is in solution. The final rolling temperature should be at a level at which there is still no chromium carbide precipitation, but at which the microstructure still recrystallizes. The term "final rolling temperature" refers to the temperature of the rolling stock in the last stand or the last stands of the finishing train. Thereafter, preferably immediately thereafter, the rolling stock is quenched to temperatures below 600° C. and preferably below 450° C. This rapid cooling prevents precipitation, especially precipitation of chromium carbides. All together, this results in a rolled product that is already heat-treated. Compared to a product that was subjected to a separate solution heat treatment and a quenching operation, this product has the advantage that its production is accomplished with savings of energy and time.

It is advantageous if the temperature of the cast product is adjusted to values of 1,000-1,150° C. in the preheating stage and is then raised to values above 1,200° C. in the subsequent intensive heating zone. This has the special advantage that the preheating can be accomplished in a roller hearth furnace, while the heating step in which the temperature is raised to above 1,200° C. is shifted to an inductive heating zone. This prevents overloading of the roller hearth furnace, which could possibly lead to its thermal destruction. The slab temperature is raised to temperatures of 1,000-1,150° C. in the gas-fired or oil-fired preheating furnace without exceeding the loading capacity of the furnace elements.

To avoid unfavorable effects of a strongly heated layer of furnace scale on the surface quality of the rolling stock, the surface of the cast product, especially the surface of the slab, is descaled before the temperature is adjusted to the run-in temperature. A descaling system is installed between the preheating stage and the intensive heating stage for this purpose. The adjustment to the run-in temperature is then carried out in the inductive intensive heating zone. It is also proposed that this descaling or an additional descaling be carried out before the roller hearth furnace of the preheating stage to protect the rollers of the furnace from scale and thus the surfaces of the slabs from unwanted scale marks, and to improve the heat transfer into the slab.

As an additional embodiment of the means of adjusting to the desired high final rolling temperature, it is further proposed that, in addition, the rolling stock be heated, preferably inductively, in the last section of the finishing train. This ensures that towards the end of the rolling operation, the temperatures of the rolling stock are reliably held at levels at which recrystallization processes occur.

It is proposed as a further development that the rolling stock be conveyed at the defined final rolling temperature through a preferably inductive heating zone that follows the finishing train in order to continue maintaining it at temperatures at which recrystallization processes occur at an accelerated rate and that it be quenched only subsequently. This has the advantage that greater amounts of time are made available for desirable recrystallization processes due to the associated decrease in strength. This heating zone can be used if it is determined that the desired final rolling temperature could not be achieved despite high run-in temperatures, for example, due to an unintended unfavorable rolling result.

An installation of the invention for carrying out the proposed method is characterized by the fact that the temperature adjustment system comprises an installation for preheating the cast product and an installation for intensive heating for adjustment of the run-in temperature ($T_{ein}$) of the cast product into the finishing train of the rolling mill above 1,150° C., and preferably above 1,200° C. for the purpose of establishing a desired final rolling temperature ($T_{we}$) to make it possible to carry out a heat treatment by directly exploiting the rolling heat.

In this regard, the means for establishing the desired high final rolling temperature are part of the temperature adjustment system, i.e., by establishing a high run-in temperature, a high final rolling temperature is also established by taking into account the temperature gradient during the rolling operation. To protect the preheating furnace, which is especially a roller hearth furnace, a temperature adjustment system of this type consists of a preheating installation and a subsequent inductive intensive heating zone.

To maintain the final rolling temperature ($T_{we}$) after the rolling, a heating zone is provided downstream of the rolling mill. This heating zone is preferably heated by induction heating, and temperatures above 1,000° C. can be established. A continuous pusher-type furnace can also be used.

Other details and advantages of the invention are apparent from the dependent claims and from the following description, in which the embodiments of the invention illustrated in the drawings are explained in greater detail.

FIG. 1 shows an installation for producing sheet or strip made of grades of steel alloyed with chromium and nickel, which are rolled and heat-treated without being cooled to room temperature, so that the final product is already available in a solution heat-treated and quenched state.

Figure 1:
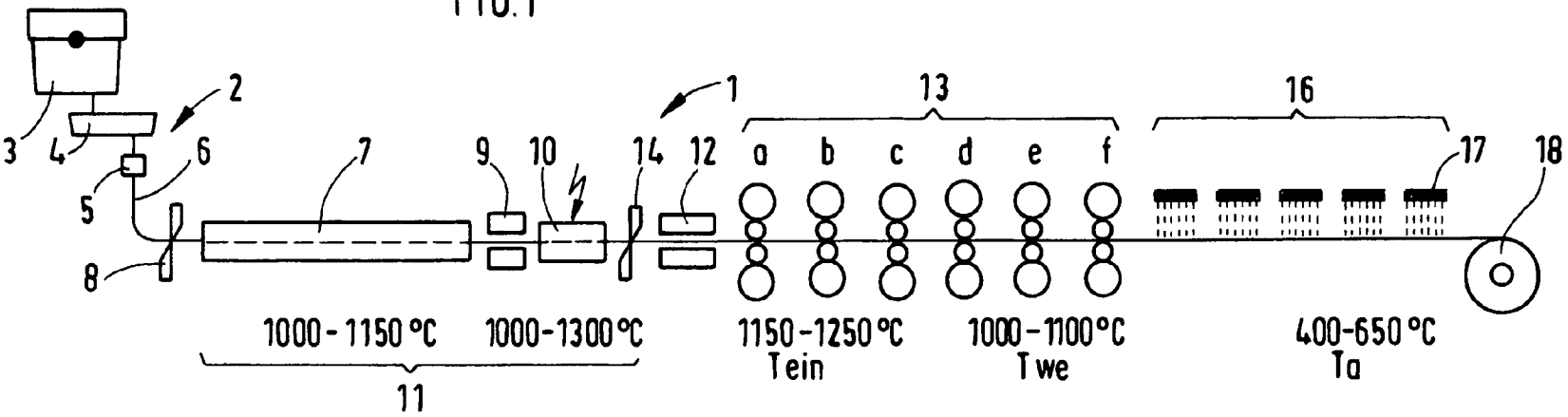
FIG. 1 shows an installation for carrying out the proposed method in accordance with a first embodiment.

An installation 1 of this type comprises a continuous casting machine 2, which is shown schematically in the drawing with a ladle 3 for the molten steel, a tundish 4 and a mold 5. The near-net-shape cast strand or cast product 6 is cut into slabs by a shear upstream of the roller hearth furnace or preheating furnace 7, and the slabs then enter the furnace 7 to be heated to temperatures of 1,000-1,150° C. and to undergo temperature equalization. The heated slabs pass through a descaling system 9 and are then conveyed into an inductive intensive heating zone 10, in which they are heated in a short, rapid heating process to temperatures in the range of 1,000-1,300° C., and preferably above 1,200° C. The temperature to which the slabs are adjusted in the intensive heating zone 10 must be sufficient to establish the desired final rolling temperatures above 1,000° C. Heating to temperatures around 1,000° C. may be sufficient in certain cases if only very small temperature losses occur during the rolling operation. The preheating furnace 7 and the intensive heating zone 10 constitute the temperature adjustment system 11. The means for carrying out the heat treatment are the preheating furnace 7, the intensive heating zone 10, and the cooling zone for rapid cooling.

After the hot slabs have passed through the intensive heating zone 10, they are descaled again (second descaling system 12) and are then passed into the finishing train 13, which in the present case consists of six stands 13*a-f*. The run-in temperatures are in the range of 1,050-1,250° C., and preferably above 1,200° C. Temperatures of 1,050° C. can also be established if the temperature loss in the rolling train is low and the desired final rolling temperatures are achieved. An emergency shear 14 is provided upstream of the second descaling system 12 in case operating problems arise.

During the rolling operation, the slab temperatures decrease due to radiation and cooling, but they do not fall to temperatures below 1,000-1,100° C. by the end of the rolling train 13, so that the chromium always stays in solution, chromium carbides cannot precipitate on the grain boundaries of the microstructure, and complete recrystallization occurs. The rolling stock 15 then enters the cooling system 16 or a cooling zone, whose cooling parameters are adjusted in such a way that the rolling stock is rapidly cooled to temperatures of 400-650° C., and preferably below 600° C., so that the dissolved Cr atoms are forced to remain in solution. The cooling zone shown here consists of cooling bars 17 with water cooling, but other types of cooling are also conceivable.

The strip that has been rolled in this way and has already been heat-treated and is thus corrosion-resistant, is then coiled by a coiler 18.

Figure 2:
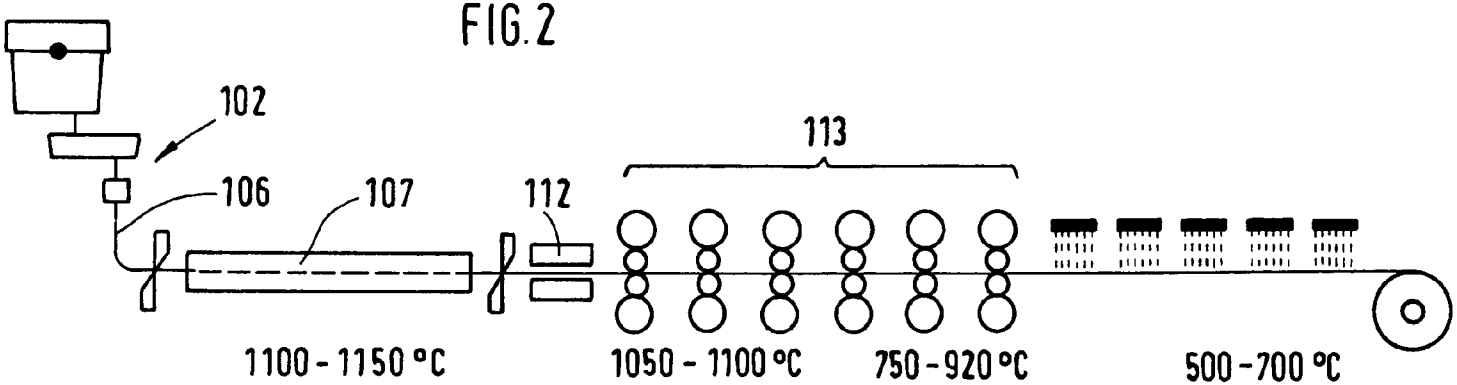
FIG. 2 shows a prior-art installation

For comparison, FIG. 2 shows a prior-art installation for rolling from the casting heat, in which the strip must be subjected to a solution heat treatment in a separate process. The parts of the installation that correspond to the same parts in FIG. 1 are provided with corresponding reference numbers. In addition, customary slab and strip temperatures that prevail or are established in the individual sections of the installation are specified. In an installation of this type, the cast product 106 is cut, passed through a soaking furnace 107, and then rolled. The solution heat treatment, which is carried out in an annealing furnace in a separate part of the installation and is followed by a quenching operation, is not shown here.

The invention is intended especially for austenitic stainless steels, i.e., steels containing at least 10.5 wt. % Cr and at most 1.2 wt. % C. The invention is aimed especially at stainless steels in which intergranular corrosion by Cr depletion with precipitation of chromium carbides is to be prevented. The proposed method makes it possible to produce stainless steels that are already solution-annealed and thus corrosion-resistant after their passage through an in-line casting and rolling installation. This saves energy and time and thus costs. The sequence of operations for producing corrosion-resistant stainless steels is shortened.

The invention claimed is:

1. Installation (1) for producing hot-rolled strip from austenitic stainless steels, which is to be used to carry out a method in which, in a first step, a cast slab (6) is subjected to a rolling operation in a rolling mill with a finishing train and, in a second step, a heat treatment is carried out to prevent susceptibility to corrosion, and which comprises a continuous casting machine (2) for producing a cast slab (6) and a rolling mill (13) with a temperature adjustment system (11), which is installed upstream of the rolling mill, and a cooling system (16) for cooling the rolling stock (15), which is installed downstream of the rolling mill, wherein the temperature adjustment system (11) comprises an installation (7) including a furnace for preheating the cast slab to a first temperature of ≦1,150° C. and an installation (10) for intensive heating including an inductive heating zone for adjustment of the run-in temperature (Tein) of the cast slab into the finishing train of the rolling mill to a second temperature above 1,150° C., for the purpose of establishing a final rolling temperature (Twe) to carry out the heat treatment by direct exploitation of the rolling heat, wherein the cooling system (16) for cooling the rolling stock comprises means for quenching (16) the rolling stock to temperatures below 600° C., to prevent the precipitation of chromium carbides during cooling, the temperature adjustment system further comprising a first descaling system between the preheating installation (7) and the intensive heating installation (10), wherein only the first descaling system is located between the preheating installation (7) and the intensive heating installation (10).

2. Installation in accordance with claim 1, wherein it has a heating zone after the rolling mill for maintaining the final rolling temperature (Twe) of the rolling stock at temperatures above 1,000° C., and preferably above 1,050° C.

3. Installation in accordance with claim 1, wherein it has means for further heating the rolling stock during rolling to establish a final rolling temperature (Twe).

4. Installation in accordance with claim 1, which comprises a continuous casting machine (2) for casting near-net-shape cast products (6), a device (8) for shearing the cast product (6) upstream of the temperature adjustment system (11), a second descaling system (12) between the temperature adjustment system (11) and a finishing train (13) of the rolling mill, an installation for rapid cooling (16), which follows immediately after the finishing train (13) or a soaking furnace, and a device for coiling (18) the strip or a device for cutting and stacking the heat-treated rolling stock.

5. Installation in accordance with claim 1, which comprises a temperature adjustment system for heating continuously cast slabs or billets, possibly a roughing stand, and a hot wide strip rolling train or wire mill that follows it, an installation for rapid cooling that directly follows the hot wide strip rolling train or wire mill or a soaking furnace, and a device for coiling the strip or a device for cutting and stacking or winding the heat-treated rolled product.

* * * * *